US007854027B1

(12) United States Patent
Dugat, III

(10) Patent No.: US 7,854,027 B1
(45) Date of Patent: Dec. 21, 2010

(54) TOILET FLAPPER VENTILATION SYSTEM

(76) Inventor: Rufus Dugat, III, 2820 McKinnon St., Apt. 2068, Dallas, TX (US) 75201

( * ) Notice: Subject to any disclaimer, the term of this patent is extended or adjusted under 35 U.S.C. 154(b) by 452 days.

(21) Appl. No.: 12/030,115

(22) Filed: Feb. 12, 2008

(51) Int. Cl.
*E03D 9/04* (2006.01)

(52) U.S. Cl. ..... 4/213

(58) Field of Classification Search ..... 4/213, 4/216–217, 350–351, 392–404
See application file for complete search history.

(56) References Cited

U.S. PATENT DOCUMENTS 3,546,714 A * 12/1970 Middleton ..... 4/370
3,579,650 A * 5/1971 Sloan ..... 4/347
3,781,923 A * 1/1974 Maisch et al. ..... 4/213
4,318,192 A 3/1982 Williams et al.
5,231,705 A * 8/1993 Ragusa ..... 4/213
5,353,443 A * 10/1994 Sim ..... 4/216
5,839,127 A 11/1998 Curiel
6,279,173 B1 8/2001 Denzin et al.

* cited by examiner

*Primary Examiner*—Charles Phillips
(74) *Attorney, Agent, or Firm*—Carr LLP; Theodore F. Shiells

(57) ABSTRACT

A toilet flapper ventilation system includes a water-tight electric fan enclosed in a structure which slows the descent of the flapper section through the water in the toilet tank. A guiding system is used to direct the flapper section's rise and fall, and ensure its water-tight return to the flapper valve. The cusp at the lower end of the flapper section has an angled opening which directs the suction of the fan from the toilet bowl through the water discharge tube. The upper end of the flapper section is connected to a flexible, hollow tube which directs the air flow through a filtration system.

10 Claims, 4 Drawing Sheets

TOILET FLAPPER VENTILATION SYSTEM

BACKGROUND OF THE INVENTION

The present invention relates to a ventilation system, and more particularly, to the type that removes odors from toilet bowls.

Many ventilation systems have been implemented today to remove odor. These systems can be broadly categorized into several groups according to their mode of operation.

One broad category removes odors from the toilet bowl via the toilet's sewer line.

Another broad category removes odors from the toilet bowl via the toilet tank's overflow tube which is connected to a filtration system or a ceiling fan.

A third category removes odors from the toilet bowl via a customized toilet seat which is connected to a filtration system.

All of the aforementioned categories are effective in their own way, but separately they either lack the ability to be massively adaptable to other toilets, relatively inexpensive, easy to install, or able to extract the odor before it diffuses throughout the lavatory.

Accordingly, the object and purpose of the present invention is to make these disadvantages obsolete.

SUMMARY OF THE INVENTION

In one embodiment, a toilet closure valve ventilation system is provided having a toilet bowl having a rim and a toilet tank having a flushing mechanism which utilizes a valve closure assembly having a movable closure valve to release the water held in said toilet tank into the bowl through a water flow discharge conduit leading to water inlet openings under the rim. A movable closure valve is provided having a hollow cusp having an opening therein permitting air to flow through the cusp from the water conduit and into a flexible conduit in the toilet tank. An electric fan in fluid communication with water flow discharge conduit permits, when the water flow discharge conduit is not filled with water, suctioning air from the openings under the rim, into the water flow discharge conduit, through the hollow cusp of the movable closure valve, and then into the flexible conduit.

The toilet flapper ventilation system will be massively adaptable to toilets utilizing a flapper or other movable closure to open and discharge the water held in the toilet tank because it does not require any modifications to any part of the toilet. Two shafts can be used to guide the movement of the flapper, and these can connect to the toilet tank using an adhesive or other convenient attachment and the filtration system can hang from the toilet tank's wall.

The present invention will be relatively inexpensive attributable to the simplicity of the design and materials used.

The toilet flapper ventilation system will be easy to install since there are only three basic installation steps: hang filtration system, connect flapper to the toilet's flushing mechanism, and adhere or otherwise attach the two shafts to the toilet tank.

The present invention will extract the odor before it diffuses throughout the lavatory because the odor is being extracted directly from the toilet bowl.

BRIEF DESCRIPTION OF THE DRAWINGS

The following description will clarify the intent and construction of the toilet flapper ventilation system when assessed in conjunction with the accompanying drawings in which.

DETAILED DESCRIPTION OF THE PREFERRED EMBODIMENT

Figure 1:
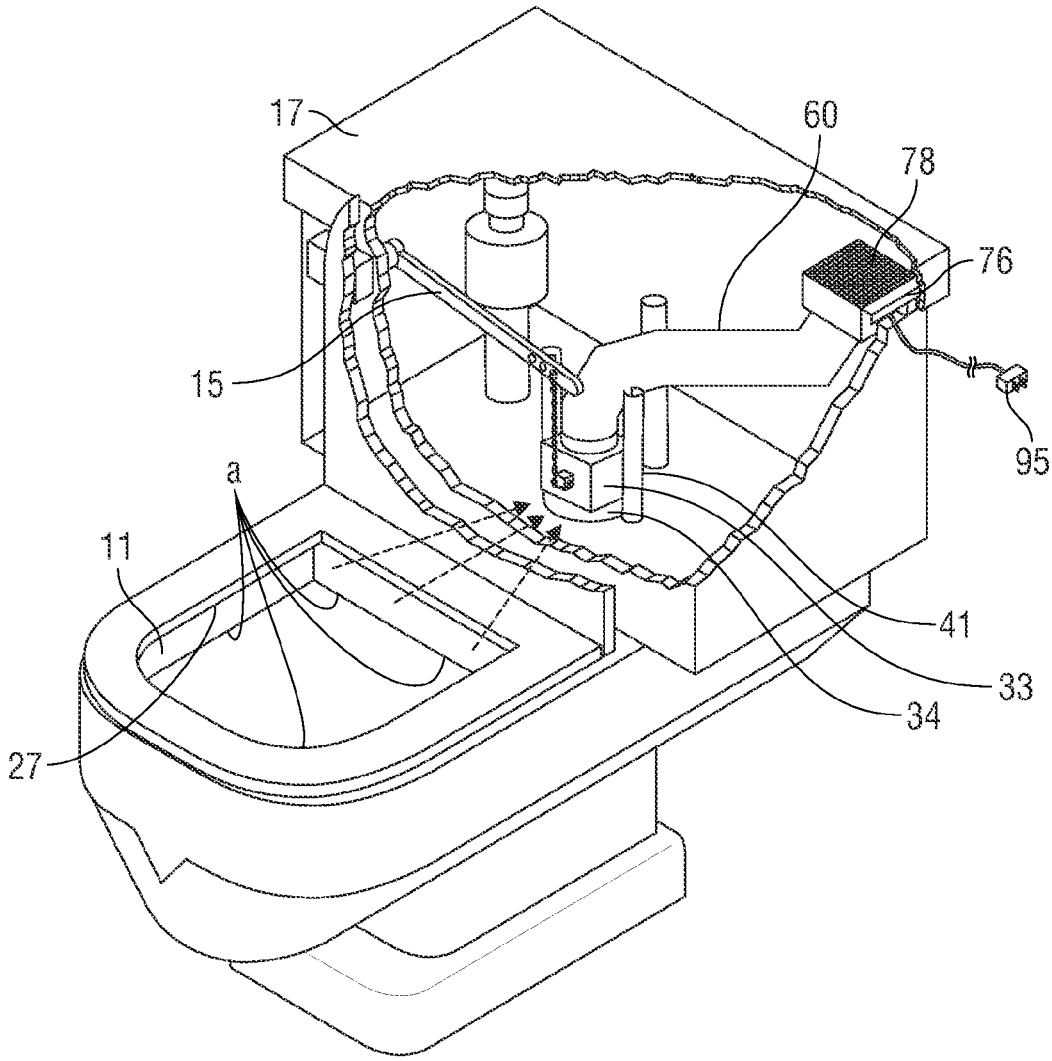
FIG. 1 is a southeast isometric view of a ventilated toilet equipped with the present invention.
Figure 2:
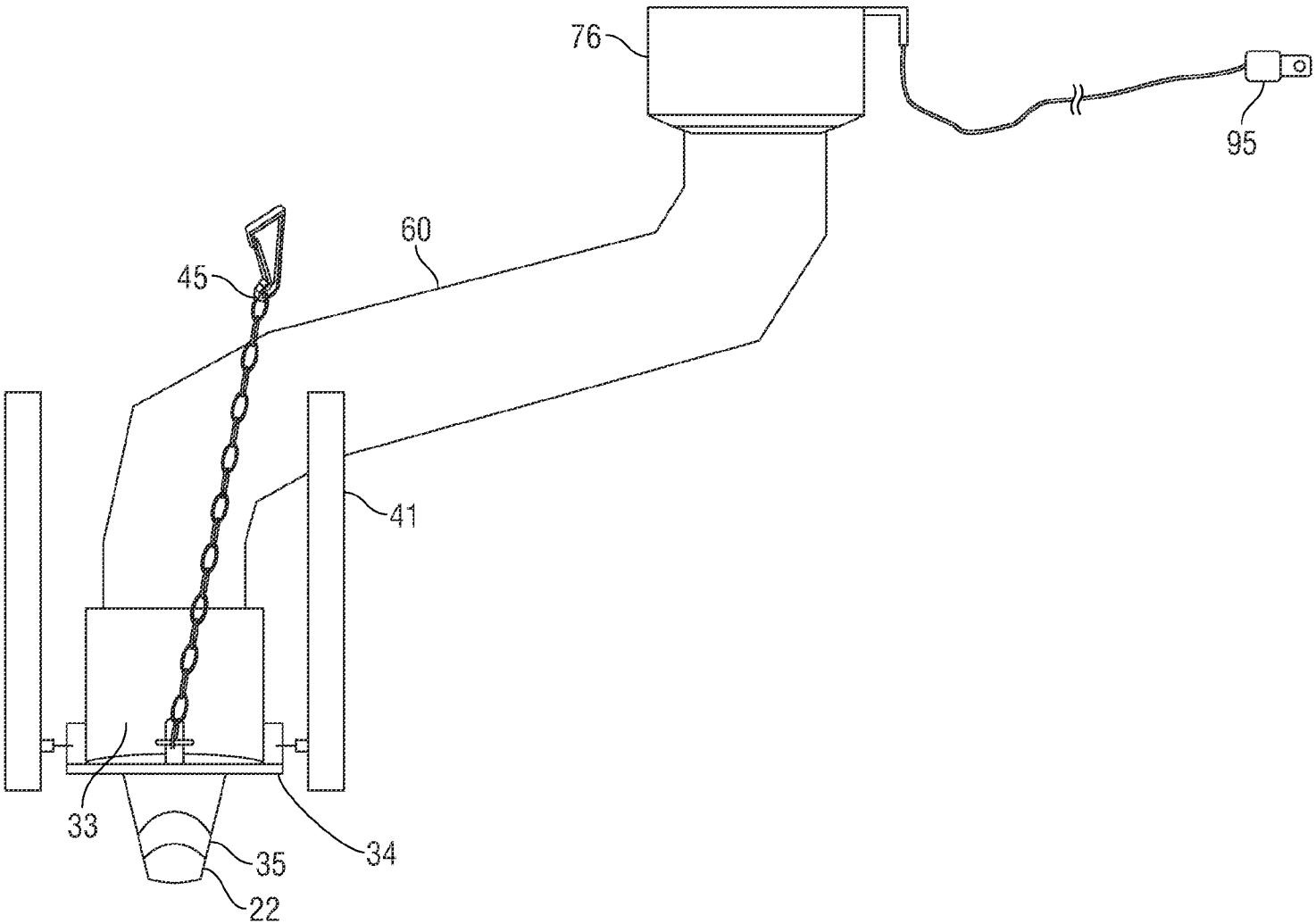
FIG. 2 is a front view of the toilet flapper ventilation system.
Figure 3:
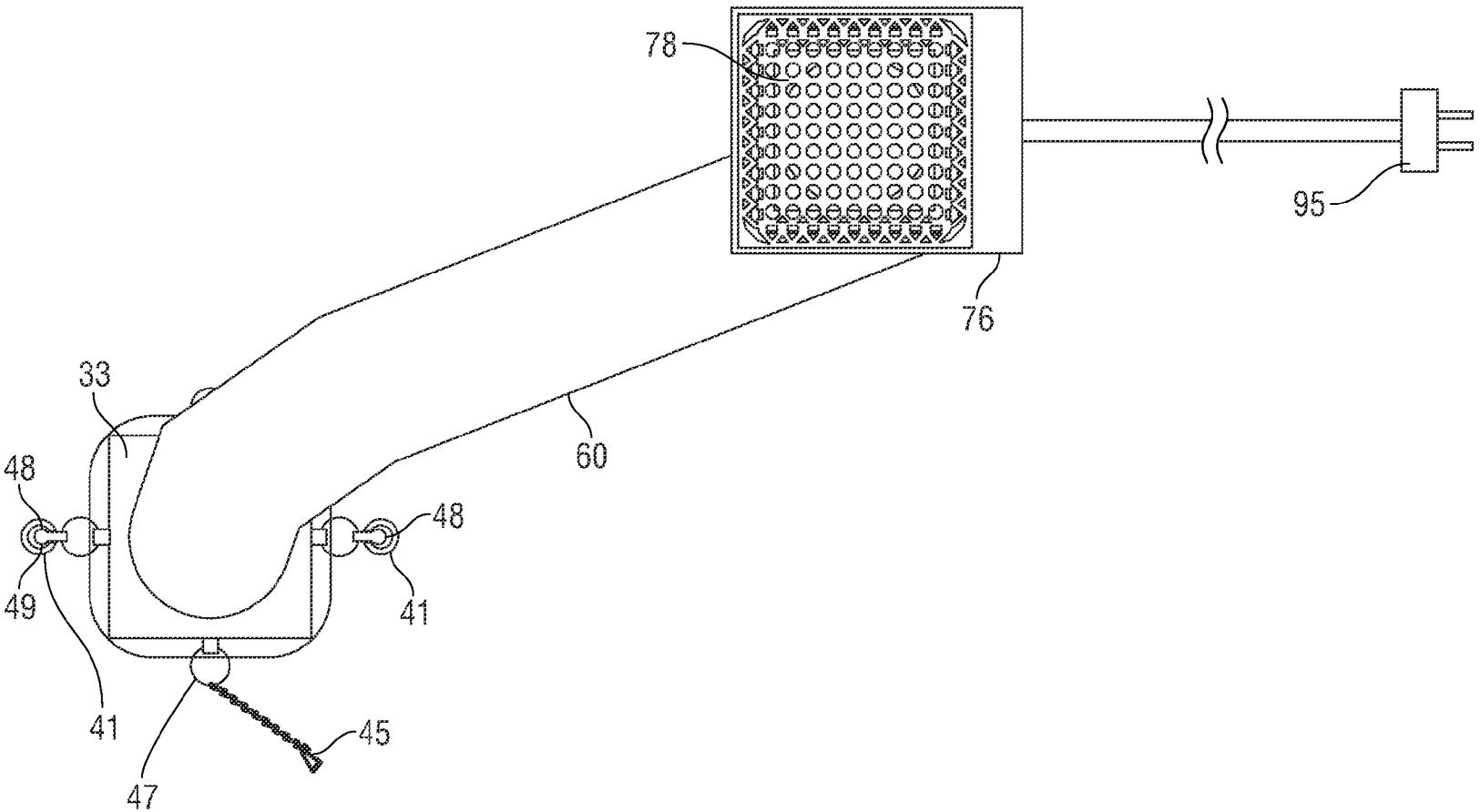
FIG. 3 is a top view of the toilet flapper ventilation system.
Figure 4:
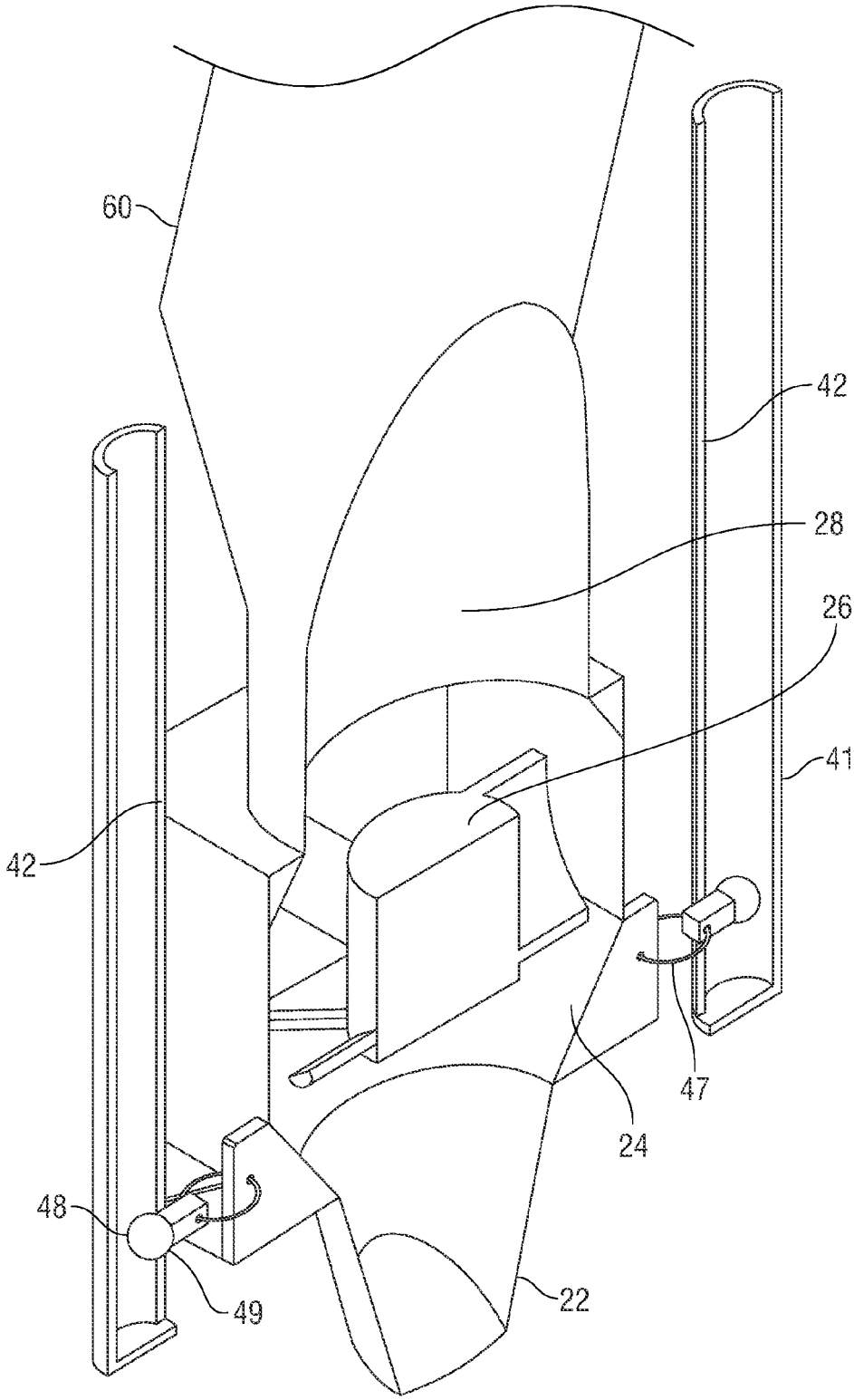
FIG. 4 is a southwest isometric cross sectional view of the flapper section of the present invention.

Reference to the drawings will now be made to describe in detail the embodiments of the present invention. The same reference number will be used wherever possible to refer to the same or like parts throughout the drawings. The toilet flapper ventilation system is fully inside the toilet tank 17, shown in FIG. 1, and rest on the original flapper valve of the toilet tank.

Through the use of a water-tight electric fan 26, the flapper section 33 of the toilet flapper ventilation system will suction out the odor from the toilet bowl 11 via the multiple water discharge apertures 27 which are located beneath the rim of the toilet bowl.

The odor, represented by the dotted lines "a" in FIG. 1, then travels up through the toilet's existing water discharge tube, which normally conducts water from the toilets tank to the water discharge apertures 27 during a flushing operation, in the opposite direction to the direction that water discharges through the water discharge tube during normal flushing.

The hollow cusp 22 at the bottom of the flapper section 33, which can have an angled lower end to direct the suction flow of the water-tight electric fan 26, hangs through the flapper valve seat 34 and has an opening 35 into it to allow air to be drawn into it.

The flapper section 33 is assembled with a water-tight electric fan 26 that sits between an upper piece 28 and lower piece 24, which pieces can be of material less dense than water, for example foam. The hollow cusp 22 and the pieces 28 and 24 can have their center open and shaped in a way to maximize the flow of the odor being suctioned by the water-tight electric fan 26 through the opening in hollow cusp 22 into lower piece 24. The outer portion of the flapper section 33 can be coated with a layer of rubber or other elastomeric material, similar to what a conventional flapper is made of.

After passing through lower piece 24, the odor then travels through a flexible tube 60 which directs it to the filter housing 76. The filter housing 76 can hang on the wall of the toilet tank 17 and holds the filtration system 78. The filtration system 78 can include a carbon filter, which removes the odor from the airflow, and can also include a perfume pad, which gives the cleansed airflow a pleasant aroma.

The water-tight electric fan's power cord 95 can extend from the electric fan 26, through the flexible tube 60, through the inside of the walls of the filter housing 76, and out of the wall of the filter housing 76 that hangs on the outside of the toilet tank 17. The power cord 95 can lead to a continuous source of power, such as a wall outlet, or can lead to a battery pack (not shown). As an alternative to placing water-tight electric fan 26 in the flapper section 33, the fan 26 could be placed above the water line, in flexible tube 60 or in the filter housing 76.

When the toilet is flushed, the flushing lever 15 pulls up on the flapper section's chain 45. The flapper section's chain 45 can be connected to a metal ring 47 that is also connected to the flapper section 33. The upward force then breaks the water-tight seal between the flapper section 33 and the flapper valve seat 34. After that, because it is at least partially buoyant, the flapper section 33 floats toward the top of the water. This buoyancy slows the descent of the flapper section through the water in the toilet tank when the toilet tank is draining. While floating upwards, the flapper section 33 and part of the flexible tube 60 will fill with water but will not reach the filtration system 78 due to the filter housing 76 is hanging above the water level and the water level is constantly lowering.

While floating to the top of the water and lowering back down consequent to the constantly dropping water level, the flapper section 33 can remain vertically aligned with the flapper valve. This can be facilitated through the use of guides, such as two hollow tubes 41. Hollow tubes 41 can guide the spherical ended 48 rods 49 along a vertical path. The hollow tubes 41 can be adhered or otherwise attached to the toilet tank 17 near the flapper valve. Adhesive can be conveniently used. The hollow tubes 41 have an open slot 42 on their side that is wide enough to allow the rectangular part of the spherical ended rods 49 to fit within, but is not wide enough to allow the spherical ends 48 of the rods 49 to pass through. As an alternative to the spherical ended rods 49, a cylinder or other shape can be used, provided that it fits into around the tubes 41 so that it slide up and down freely on the tubes 41. The opposite ends of the rods 49 are connected to a metal rings 47 which are connected to the flapper section 33. The spherical ended rods 49 have enough space between them and the wall of the open side of the hollow tube 41 to allow a few degrees of forward and backward pivotal motion to ensure the flapper section 33 makes a water-tight seal with a flapper valve seat 34 that is set at a slight angle.

With the use of metal rings 47 to connect the spherical ended rods 49 and the flapper section's chain 45, they can be rearranged on the flapper section 33 to make certain that the hollow cusp 22 will point down the discharge tube towards the toilet bowl 11 regardless of what direction the flapper valve is configured in the toilet tank 17.

The foregoing description should be considered exemplary of the objectives and advantages of the present invention. But it shall also be understood that modifications, variations, and substitutions may be made without departing from the inventive concept of this invention.

What is claimed is:

1. A toilet closure valve ventilation system comprising:

a toilet bowl having a rim;

a toilet tank having a flushing mechanism which utilizes a valve closure assembly having a movable closure valve to release the water held in said toilet tank into the bowl through a water flow discharge conduit leading to water inlet openings under the rim, the movable closure valve having a hollow cusp having an opening therein permitting air to flow through the cusp from the water flow discharge conduit and into a flexible conduit connected to said movable closure and being at least in-part movable therewith, and an electric fan in fluid communication with the water flow discharge conduit permitting, when the water flow discharge conduit is not filled with water, suctioning air from the openings under the rim, into the water flow discharge conduit, through the hollow cusp of the movable closure valve, and then into the flexible conduit.

2. The toilet closure valve ventilation system defined in claim 1, wherein the electric fan is water-tight and is disposed in the valve closure assembly.

3. The toilet closure valve ventilation system defined in claim 1, wherein the electric fan is positioned above the highest water line for the water held in the toilet tank, in fluid communication with the air in the flexible conduit.

4. The toilet closure valve ventilation system defined in claim 1, further comprising guides to direct the rise and fall of said movable valve closure to facilitate the valve closure returning to make a water-tight seal with the valve closure seat.

5. The toilet closure valve ventilation system defined in claim 1, wherein the closure valve includes a flapper.

6. The toilet closure valve ventilation system defined in claim 1, wherein the flexible conduit is water-tight.

7. The toilet closure valve ventilation system defined in claim 1, wherein the electric fan is disposed in a valve closure assembly that moves with the movable closure valve and at least partially buoyant to slow the descent of the valve closure assembly through the water in the toilet tank when the toilet tank is draining.

8. The toilet closure valve ventilation system defined in claim 1, wherein the flexible conduit leads to an air filter to remove odors from the air.

9. The toilet closure valve ventilation system defined in claim 8, wherein the air filter includes a carbon odor absorber.

10. The toilet closure valve ventilation system defined in claim 8, wherein the filter includes a scented air freshener.

* * * * *